US005144727A

United States Patent [19]

Craft

[11] Patent Number: 5,144,727

[45] Date of Patent: Sep. 8, 1992

[54] NON-INVASIVE HARDWARE FOR METAL CASKET

[75] Inventor: William K. Craft, North Bend, Ohio

[73] Assignee: Batesville Casket Company, Inc., Batesville, Ind.

[21] Appl. No.: 685,150

[22] Filed: Apr. 15, 1991

[51] Int. Cl.[5] ..... A61G 17/00

[52] U.S. Cl. ..... 27/2; 16/112

[58] Field of Search ..... 27/2, 10; 16/112

[56] References Cited

U.S. PATENT DOCUMENTS 1,185,655 6/1916 Govro ..... 16/112

1,227,929 5/1917 Ralston ..... 16/112

1,779,488 10/1930 Patterson ..... 27/2

1,979,854 11/1934 Beck ..... 16/112

5,008,990 4/1991 Craft ..... 27/2

*Primary Examiner*—Richard E. Chilcot, Jr.

*Attorney, Agent, or Firm*—Wood, Herron & Evans

[57] ABSTRACT

Non-invasive hardware for a metal casket. A casket wall is deformed to form a recess. A slotted plate is welded to the recess. A hardware assembly includes a rivet head that is slid into the slot and under the plate. A plastic strip mates with the slot to hold the hardware assembly from slipping out from the slot in the plate.

6 Claims, 3 Drawing Sheets

NON-INVASIVE HARDWARE FOR METAL CASKET

BACKGROUND OF THE INVENTION

This invention relates to hardware for a metal casket.

A casket is formed as a deep, hollow metal shell which is closed by a cap or top. Much effort is expended to provide assurance that the casket is leak-tight so that water cannot leak into the casket when the casket is buried underground. It is also important that body gases not leak out of the casket when the casket is disposed in a mausoleum. Special gaskets have been designed for the engagement of the cap with the shell to prevent leaking around the perimeter of the casket. One of the final steps in the manufacturing process of a casket is to pressure test the, casket with the lid closed upon its shell to determine whether the casket, before it is shipped, is indeed leak-tight.

The casket hardware presents a potential site for leakage. Conventionally, holes are drilled through the wall of the shell. Bolts pass through those holes to mount the hardware to the shell, the hardware providing the handles by which the casket is carried. Washers must be mounted on the bolts to provide a seal around the holes.

The hardware is the point of greatest stress when the casket is handled. There is always the potential for the rupture of the leak-tight seal around each bolt that attaches the hardware to the shell. Wherever a hole is formed in a casket, the potential for a leak exists. Typically, there are 8–16 holes employed in the mounting of hardware. To eliminate such holes is to eliminate potential for leaking.

BRIEF SUMMARY OF THE INVENTION

The objective of the present invention has been to provide non-invasive hardware for a casket, that is, hardware that can be mounted on the casket without the necessity of drilling a hole in the casket wall.

This objective of the invention has been provided by first forming a stepped recess in a casket wall. A slotted mounting plate is welded in the recess so that it lies flush with the casket wall. A fastener fixed to the hardware has a head spaced slightly from it. That fastener is slid into the slot of the mounting plate so as to underlie the mounting plate and hold the hardware to it. A flexible plastic strip overlies the mounting plate. The plastic strip has a boss that seats in the slot and prevents the strip and headed fastener from sliding out of the slot in the mounting plate.

Another feature of the invention is the provision of a stud and mating hole on the hardware and plastic strip, respectively, to maintain them in precise alignment, thus assuring that all of the parts, when mounted on the casket, will be vertically aligned.

Still another feature of the invention is the provision of spaced fingers on the hardware that space the hardware slightly from the casket shell to provide assurance that no cast metal flashing on the hardware will scratch the shell finish during installation.

Once installed, the hardware can be removed by using a screwdriver or similar instrument to flex the plastic strip away from the mounting plate, thereby disengaging the boss on the plastic strip from the slot in the mounting plate.

BRIEF DESCRIPTION OF THE DRAWINGS

The objective and several features of the invention will become more, readily apparent from the following detailed description taken in conjunction with the accompanying drawings in which.

DETAILED DESCRIPTION OF THE INVENTION

Figure 1:
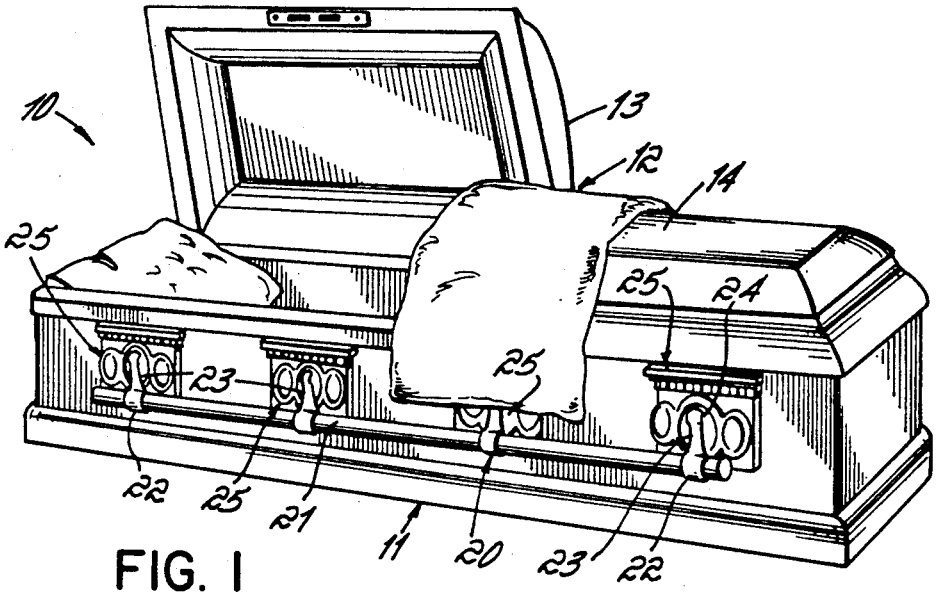
FIG. 1 is a perspective view of a casket showing its hardware mounted on the shell.

Referring to FIG. 1, there is shown a casket 10 having a sheet metal shell 11 enclosed by a cap 12. The cap 12 has a head section 13 and a foot section 14. Seals around the perimeter of the head section and foot section are provided to form a leak-tight joint between the cap and seal.

The hardware indicated at 20 can take many forms. The illustrated hardware is simply exemplary. A bar 21 is mounted, at each of its ends, to the free end 22 of an arm 23. The arm 23 is pivoted at 24 to the shell 11, and a die-cast escutcheon 25 overlies the joint between the arm and the shell.

FIGS. 2—5 show the details of the mounting of a representative arm 23. The shell 11 is deformed to provide a stepped deboss 30 having a shoulder 31 and a void 32. A mounting plate 33 is seated on the shoulder 31 and welded thereto at two points 34 and 35. The mounting plate has a slot 40 which is formed with two lateral wings 41 and a flared entry 42.

The arm 23 has a clevis 45 mounted to it by rivet 46. The clevis has a mounting hole 47. The escutcheon 25 has a receptacle 50 having a mounting slot 51. The clevis is seated in the receptacle 50. A flexible plastic strip 52 lies against the receptacle 50 and has a mounting hole 53 aligned with the slot 51. The strip 52 also has an alignment hole 54, spaced from the mounting hole 53, which receives a stud 55 on the escutcheon to maintain the strip 52 in a precise orientation with respect to the escutcheon so that the escutcheon and arms 23 will, when mounted, be oriented in exactly the same way on the casket shell.

Figure 3:
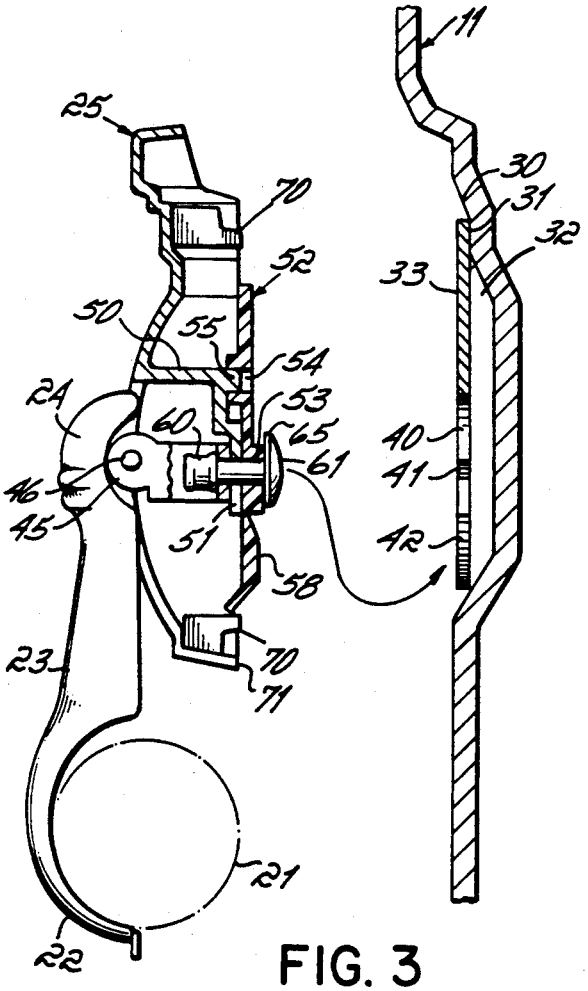
FIGS. 3, 4 and 5 are cross-sectional views illustrating the sequence of steps for mounting the hardware.

The plastic strip 52 has a boss 58 having lateral wings 59 that match the wings 41 on the mounting plate 33. A pop rivet 60 having a head 61 passes through hole 53 in the plastic strip slot 51 in the escutcheon and hole 47 in the clevis mounted on the arm 23. The pop rivet is tightly secured to the clevis 45 and the head 61 lies against a tongue-shaped embossment 64 which is smaller than the head 61 so as to leave an overhang 65 (FIG. 3). The tongue-shaped embossment 64 mates with the tongue-shaped portion of the slot 40 in the mounting plate 33.

Figure 4:
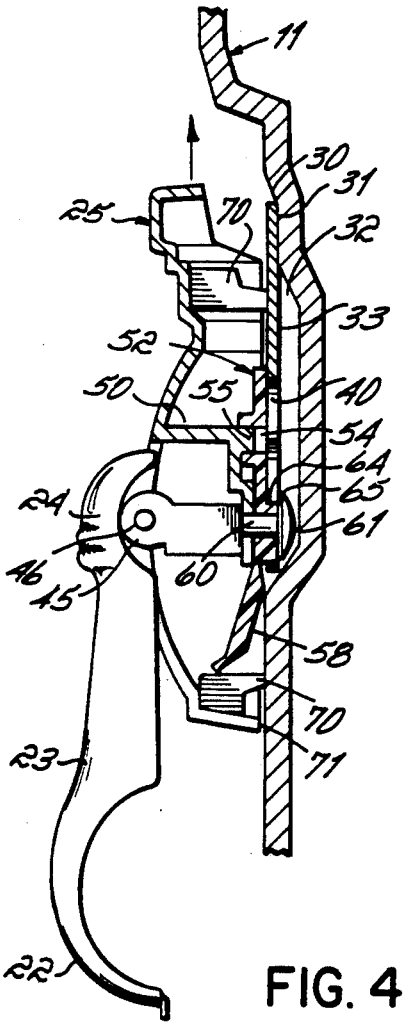
Figure 2:
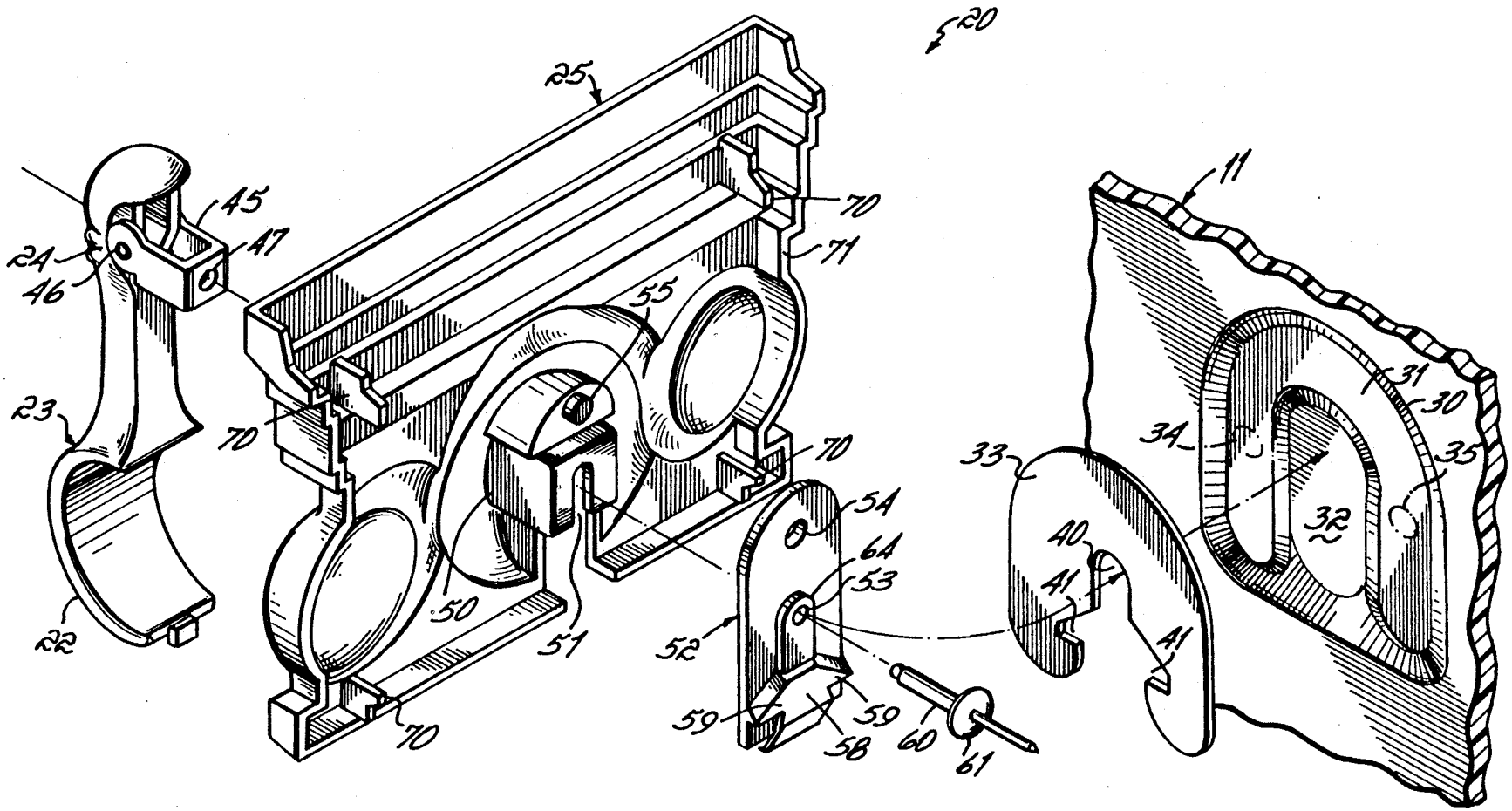
FIG. 2 is a disassembled perspective view of the hardware and mounting elements.
Figure 5:
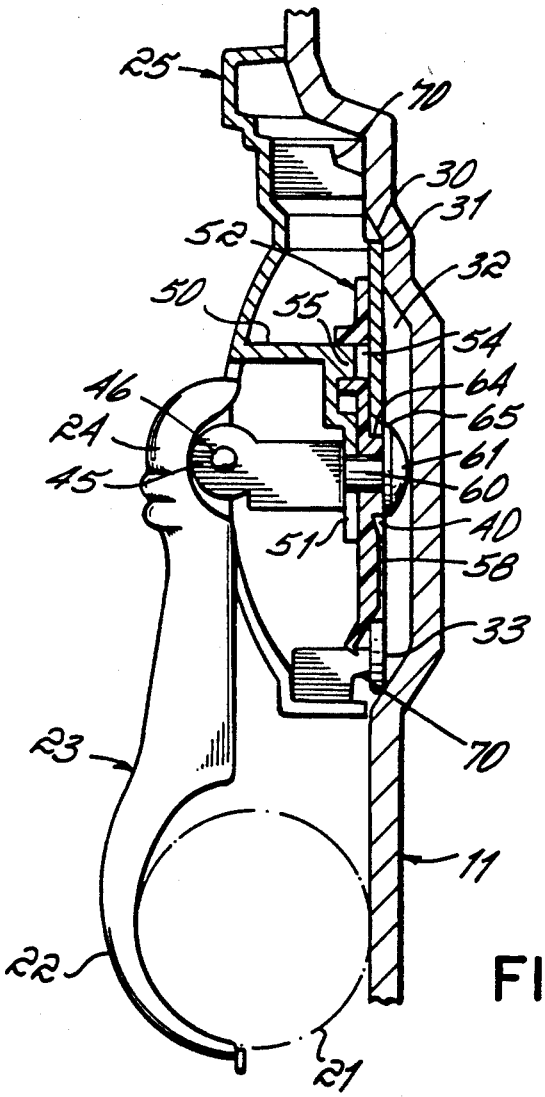

The assembly of the escutcheon 25, the arm 23 and pop rivet 60 is mounted to the casket shell in the manner illustrated in FIGS. 3, 4 and 5. As shown in FIG. 3, the hardware is laid against the mounting plate 33 with the embossment 64 and head 61 entering the flared opening 42 to bring the head to a position underlying the mounting plate as shown in FIG. 4. It can be seen from FIG. 4 that the plastic strip is flexed away from the shell during the introduction of the pop rivet 60 into the flared opening 42 of the mounting plate 33. The hardware is thrust upwardly in the direction of the arrow of FIG. 4 until the tongue-shaped embossment 64 is seated in the upper end of the slot 40. Immediately upon achieving that uppermost position of the embossment 64 in the slot 40, the boss 58 on the plastic strip drops fully into the slot 40 with the boss lateral wings 59 being seated in the slot lateral wings 41. When that position is achieved, as shown in FIG. 5, the hardware is totally immobilized on the mounting plate. It can be removed by inserting a screwdriver or similar instrument under the strip 52 to flex it upwardly substantially as shown in FIG. 4 so that the hardware can be pulled downwardly. Without the assistance of the screwdriver, however, the hardware is mounted securely in place.

It is preferred that the escutcheon has four fingers 70 mounted on its undersurface and projecting toward the perimeter 71 of the escutcheon which forms its base. Fingers 70 project slightly beyond the perimeter 71 so as to space it slightly away from the shell. These fingers provide assurance that no cast metal flashing will scratch the shell finish during installation.

From the above disclosure of the general principles of the present invention and the preceding detailed description of a preferred embodiment, those skilled in the art will readily comprehend the various modifications to which the present invention is susceptible. Therefore, I desire to be limited only by the scope of the following claims and equivalents thereof:

What is claimed is:

1. A casket and non-invasive hardware combination comprising:

a recess in said casket wall, a mounting plate welded to said wall over said recess, said plate having a single slot, a hardware assembly including a fastener having a head, said hardware assembly overlying said mounting plate with said fastener lodged in said slot and said head underlying said plate, and means cooperating with said slot for blocking withdrawal of said fastener from said slot.

2. The combination of claim 1 in which said recess is stepped presenting a shoulder and a void, said mounting plate seating on said shoulder to lie flush with said casket wall and to provide a void to receive said fastener.

3. A casket and non-invasive hardware combination comprising:

a recess in said casket wall, a mounting plate welded to said wall over said recess, said plate having a slot, a hardware assembly including a fastener having a head, said hardware assembly overlying said mounting plate with said fastener lodged in said slot and said head underlying said plate, and means blocking withdrawal of said fastener from said slot, said blocking means comprising a flexible plastic strip mounted adjacent said fastener head and spaced from said fastener head by the thickness of said plate, said slot having at least one lateral wing, said plastic strip having at least one lateral boss which drops into said slot wing and holds said fastener from sliding out of said slot.

4. The combination of claim 3 further comprising:

a stud and mating hole on said hardware assembly and plastic strip to maintain the orientation of said hardware assembly on said casket wall.

5. A casket and non-invasive hardware combination comprising:

a recess in said casket wall, a mounting plate welded to said wall over said recess, said plate having a slot, an escutcheon lying against said casket wall, an arm having a clevis seated on the opposite side of said escutcheon from said casket wall, a plastic strip mounted on said escutcheon and lying against said mounting plate, said escutcheon and plastic strip having interlocking surfaces blocking rotation of said strip with respect to said escutcheon, and a pop rivet having a head underlying said mounting plate, said pop rivet passing through said strip and said escutcheon and fixed to said clevis.

6. The combination as in claim 5 further comprising:

feet on said escutcheon spacing it slightly away from said casket wall.

* * * * *